US008690705B2

(12) United States Patent
Molinari

(10) Patent No.: US 8,690,705 B2
(45) Date of Patent: Apr. 8, 2014

(54) GOLF CLUBS AND GOLF CLUB HEADS HAVING ADJUSTABLE CHARACTERISTICS

(75) Inventor: Arthur Molinari, Beaverton, OR (US)

(73) Assignee: Nike, Inc., Beaverton, OR (US)

( * ) Notice: Subject to any disclaimer, the term of this patent is extended or adjusted under 35 U.S.C. 154(b) by 306 days.

(21) Appl. No.: 13/184,108

(22) Filed: Jul. 15, 2011

(65) Prior Publication Data

US 2013/0017898 A1 Jan. 17, 2013

(51) Int. Cl.
*A63B 53/04* (2006.01)

(52) U.S. Cl.
USPC ..... 473/331; 473/324; 473/330

(58) Field of Classification Search
USPC ..... 473/324, 330, 331, 340, 349, 219, 226, 473/231, 238, 245, 246
See application file for complete search history.

(56) References Cited

U.S. PATENT DOCUMENTS

| | | | | |
|---|---|---|---|---|
| 4,870,868 | A | 10/1989 | Gastgeb et al. | |
| 4,898,389 | A | 2/1990 | Plutt | |
| 4,940,236 | A * | 7/1990 | Allen | 473/223 |
| 5,486,002 | A | 1/1996 | Witler et al. | |
| 5,792,001 | A | 8/1998 | Henwood | |
| 5,857,694 | A * | 1/1999 | Lazarus et al. | 280/602 |
| 6,048,276 | A * | 4/2000 | Vandergrift | 473/316 |
| 6,086,490 | A * | 7/2000 | Spangler et al. | 473/564 |
| 6,196,932 | B1 | 3/2001 | Marsh et al. | |
| 6,196,935 | B1 * | 3/2001 | Spangler et al. | 473/318 |
| 6,248,021 | B1 | 6/2001 | Ognjanovic | |
| 6,362,557 | B1 | 3/2002 | Gruber et al. | |
| 6,485,380 | B2 * | 11/2002 | Spangler et al. | 473/521 |
| 8,117,903 | B2 * | 2/2012 | Golden et al. | 73/65.03 |
| 8,156,793 | B2 * | 4/2012 | Golden et al. | 73/65.03 |
| 8,172,694 | B2 * | 5/2012 | Golden et al. | 473/223 |
| 8,449,410 | B1 * | 5/2013 | Kaufman | 473/549 |
| 2001/0001770 | A1 * | 5/2001 | Spangler et al. | 473/221 |
| 2002/0077189 | A1 | 6/2002 | Tuer et al. | |
| 2003/0199335 | A1 | 10/2003 | Bissonnette et al. | |
| 2005/0037862 | A1 * | 2/2005 | Hagood et al. | 473/345 |
| 2005/0130764 | A1 | 6/2005 | Frame | |
| 2005/0192129 | A1 * | 9/2005 | Kuwabara | 473/520 |
| 2007/0205701 | A1 | 9/2007 | Grumm | |
| 2007/0258329 | A1 | 11/2007 | Winey | |
| 2010/0292024 | A1 * | 11/2010 | Hagood et al. | 473/329 |
| 2011/0028240 | A1 | 2/2011 | Wahl et al. | |
| 2013/0017898 | A1 * | 1/2013 | Molinari | 473/245 |

FOREIGN PATENT DOCUMENTS

| | | |
|---|---|---|
| WO | 99/52606 | 10/1999 |
| WO | 2010110978 | 9/2010 |

OTHER PUBLICATIONS

ISR & WO mailed Nov. 7, 2012 for Application No. PCT/US2012/046903.

* cited by examiner

*Primary Examiner* — Raleigh W Chiu
(74) *Attorney, Agent, or Firm* — Banner & Witcoff, Ltd.

(57) ABSTRACT

A golf club head which may include a golf club head body, a ball striking face and a piezoelectric member in the golf club head, wherein the piezoelectric member is configured to be selectively adjusted by an input provided through a controller operably connected to the piezoelectric member. Further, the piezoelectric member may be capable of having a first configuration to provide the golf club head body with a first attribute and may also be capable of having a second configuration to provide the body with a second attribute in response to the input provided by the controller. Further, the second attribute may be different from the first attribute.

37 Claims, 10 Drawing Sheets

GOLF CLUBS AND GOLF CLUB HEADS HAVING ADJUSTABLE CHARACTERISTICS

FIELD OF THE INVENTION

The present invention relates to golf clubs and golf club heads. Particular example aspects of this invention relate to golf clubs and golf club heads having adjustable characteristics including an adjustable ball striking surface using piezoelectric materials.

BACKGROUND

The game of golf continues to gain widespread popularity. Golf is enjoyed by a wide variety of players—players of different genders and dramatically different ages and/or skill levels. Golf is somewhat unique in the sporting world in that such diverse collections of players can play together in golf events, even in direct competition with one another (e.g., using handicapped scoring, different tee boxes, in team formats, etc.), and still enjoy the golf outing or competition. These factors, together with the increased availability of golf programming on television (e.g., golf tournaments, golf news, golf history, and/or other golf programming) and the rise of well known golf superstars, at least in part, have increased golf's popularity in recent years, both in the United States and across the world.

Golfers at all skill levels seek to improve their performance, lower their golf scores, and reach that next performance "level." Manufacturers of all types of golf equipment have responded to these demands, and in recent years, the industry has witnessed dramatic changes and improvements in golf equipment. For example, a wide range of different golf ball models now are available, with balls designed to complement specific swing speeds and/or other player characteristics or preferences, e.g., with some balls designed to fly farther and/or straighter; some designed to provide higher or flatter trajectories; some designed to provide more spin, control, and/or feel (particularly around the greens); some designed for faster or slower swing speeds; etc. A host of swing and/or teaching aids also are available on the market that promise to help lower one's golf scores.

Being the sole instrument that sets a golf ball in motion during play, golf clubs also have been the subject of much technological research and advancement in recent years. Technological advancements to golf clubs have provided improved performance for golfers. Such advancements include new features directed to both golf club shafts and golf club heads. For example, the market has seen dramatic changes and improvements in putter designs, golf club head designs, shafts, and grips in recent years. For example, golf club heads can be equipped with various structures that allow the golfer to adjust the characteristics of the golf club for the golfer's particular swing tendencies or for particular types of golf shots. Additionally, other technological advancements have been made in an effort to better match the various elements and/or characteristics of the golf club and characteristics of a golf ball to a particular user's swing features or characteristics (e.g., club fitting technology, ball launch angle measurement technology, ball spin rates, etc.).

While the industry has witnessed dramatic changes and improvements to golf equipment in recent years, there is room in the art for further advances in golf club technology. For example, while golf clubs and golf club heads according to the prior art provide a number of advantageous features, they nevertheless have certain limitations. For example, golfers find certain adjustability features cumbersome to implement, and some golfers are still searching for the ability to more finely tune the adjustability of the golf club. Aspects of the present disclosure seek to overcome certain of these limitations and other drawbacks of the prior art, and to provide new features not heretofore available.

SUMMARY OF THE INVENTION

Aspects of the disclosure may relate to a golf club head including a golf club head body, a ball striking face and a piezoelectric member in the golf club head, wherein the piezoelectric member is configured to be selectively adjusted by an input provided through a controller operably connected to the piezoelectric member. Further, the piezoelectric member may be capable of having a first configuration to provide the golf club head body with a first attribute and may also be capable of having a second configuration to provide the body with a second attribute in response to the input provided by the controller. Further, the second attribute may be different from the first attribute.

Further, aspects of the disclosure may relate to a golf club which may include a golf club head with a golf club head body, a ball striking face and a piezoelectric member in the golf club head body. Further, the golf club may include a shaft configured to be engaged with the golf club head and a controller operably connected to the piezoelectric member. Additionally, the controller may be configured to allow the user to selectively adjust a configuration of the piezoelectric member by providing an input through the controller. Also, the piezoelectric member may be capable of having a first configuration to provide the golf club head body with a first attribute and may also be capable of having a second configuration to provide the body with a second attribute in response to the input provided by the controller, the second attribute being different from the first attribute.

Additional aspects of this disclosure may relate to methods for producing golf clubs and golf club heads of the types described above.

BRIEF DESCRIPTION OF THE DRAWINGS

The present invention is illustrated by way of example and not limited in the accompanying figures, in which like reference numerals indicate similar elements throughout, and in which.

DETAILED DESCRIPTION

Figure 1:
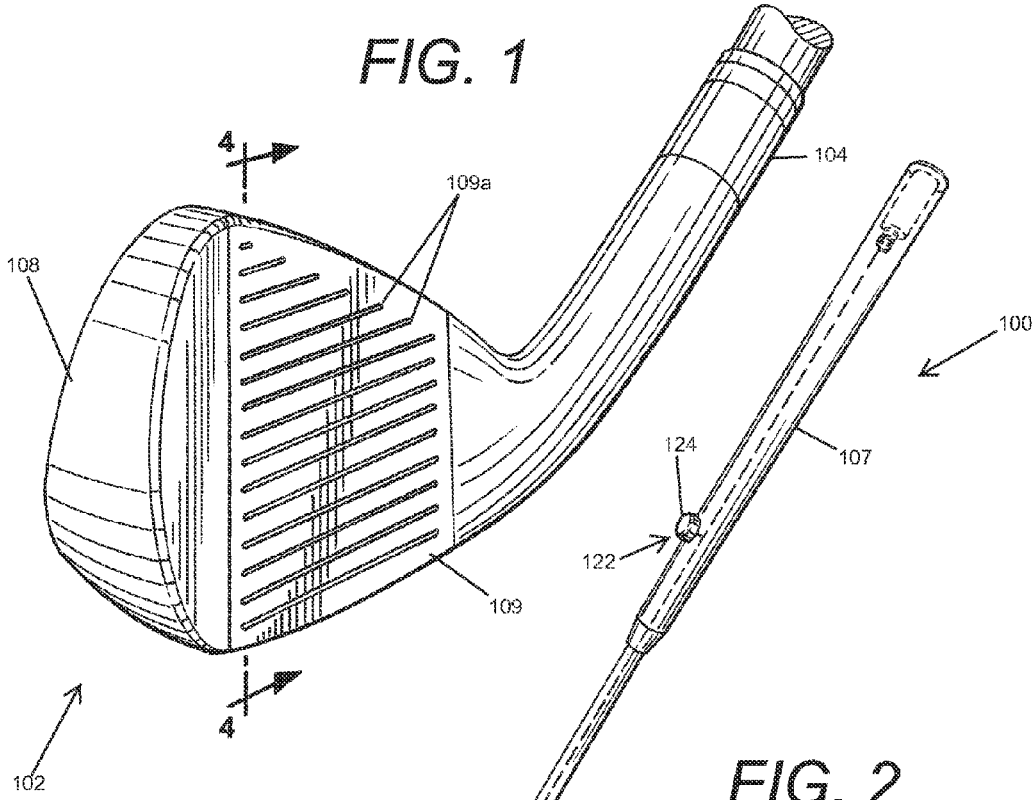
FIG. 1 is a partial front perspective view of an example golf club having an example golf club head in accordance with the present disclosure.

The following description and the accompanying figures disclose features of golf club heads and golf clubs in accordance with the present disclosure (e.g., iron or iron-type hybrid golf clubs and golf club heads).

I. General Description of Example Golf Club Heads, Golf Clubs, and Methods in Accordance with this Invention Aspects of this disclosure relate to iron-type golf club heads. Iron-type golf club heads according to at least some example aspects of this disclosure may include: (a) an iron-type golf club head body; (b) a ball striking face; and (c) at least one piezoelectric element in the iron-type golf club head body. According to aspects of this disclosure, the one or more piezoelectric elements in the iron-type golf club head may be configured to selectively adjust attributes, characteristics or properties of the iron-type golf club head. For example, according to aspects of the disclosure, the size, shape, positioning, etc. of the one or more piezoelectric elements in the iron-type golf club head may be configured to selectively control various attributes of the iron-type golf club head, including the configuration of the grooves in the iron-type golf club head (e.g., the depth, volume, shape, angle, etc. of the grooves), the stiffness or dampening ability of the iron-type golf club head, the loft of the golf club head iron-type golf club head, etc.

Additional aspects of this disclosure relate to iron-type golf clubs that include iron-type golf club heads, e.g., of the types described above and below. Such iron-type golf clubs further may include one or more of: a shaft attached to the club head (optionally via a separate hosel or a hosel provided as a part of one or more of the club head and/or shaft); a grip or handle attached to the shaft; etc.

Still additional aspects of this disclosure relate to methods for producing iron-type golf club heads and iron-type golf clubs in accordance with examples of this disclosure. Such methods may include, for example, one or more of the following steps in any desired order and/or combinations: (a) providing an iron-type golf club head of the various types described above and below (including any or all of the various structures, features, and/or arrangements described above), e.g., by manufacturing or otherwise constructing the iron-type golf club head, by obtaining it from a third party source, etc.; (b) engaging a shaft with the golf club head; and (c) engaging a grip with the shaft.

It is noted that while iron-type golf club heads, iron-type golf clubs and methods for producing iron-type golf club heads and iron-type golf clubs are discussed above, aspects of this disclosure, generally relate to all types of golf clubs and golf club heads including but not limited to wood-type golf clubs, hybrid-type golf clubs, iron-type golf clubs (including iron-type hybrid clubs, driving irons, 0-9 irons, pitching wedges, sand wedges, gap wedges, loft wedges, etc.) and putters and the respective golf club heads. Given the general description of various example aspects of the disclosure provided above, more detailed descriptions of various specific examples of golf clubs and golf club head structures according to the disclosure are provided below.

II. Detailed Description of Example Golf Club Heads, Golf Club Structures, and Methods According to the Invention The following discussion and accompanying figures describe various golf clubs and golf club head structures in accordance with examples of the present disclosure. For example, more specific examples and features of iron-type golf club heads and golf club structures according to aspects of this disclosure will be described in detail below in conjunction with the example golf club structures illustrated in FIGS. 1 and 3-12. It is noted that when the same reference number appears in more than one drawing, that reference number is used consistently in this specification and the drawings to refer to the same or similar parts throughout.

Figure 3:
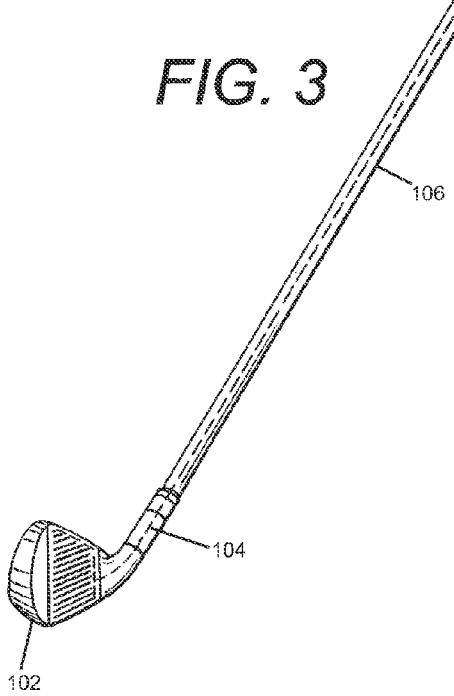
FIG. 3 is a front perspective view of the golf club shown in FIG. 1.

FIGS. 1 and 3 generally illustrate examples of an iron-type golf club 100 and an iron-type golf club head 102 according to aspects of the disclosure. As seen in FIG. 3, the iron-type golf club head 100 may include the golf club head 102 in accordance with the present disclosure. In addition to the golf club head 102, the overall golf club structure 100 of this example includes a hosel 104, a shaft 106 received in and/or inserted into and/or through the hosel 104, and a grip or handle 107 attached to the shaft 106. Optionally, if desired, the hosel 104 may be eliminated and the shaft 106 may be directly inserted into and/or otherwise attached to the golf club head 102 (e.g., through an opening provided in the top of the club head 102, through an internal hosel (e.g., provided within an interior chamber defined by the club head 102), etc.). The hosel 104 may be integrally formed as part of the club head structure 102, or it may be separately formed and engaged therewith (e.g., by adhesives or cements; by welding, brazing, soldering, or other fusing techniques; by mechanical connectors; etc.). Conventional hosels and their inclusion in an iron-type golf club head structure may be used without departing from this disclosure.

The shaft 106 may be received in, engaged with, and/or attached to the club head 102 in any suitable or desired manner, including in conventional manners known and used in the art, without departing from the disclosure. As more specific examples, the shaft 106 may be engaged with the club head body 102 via the hosel 104 and/or directly to the club head structure 102, e.g., via adhesives, cements, welding, soldering, mechanical connectors (such as threads, retaining elements, or the like), etc.; through a shaft-receiving sleeve or element extending into the club head 102; etc. If desired, the shaft 106 may be connected to the golf club head 102 in a releasable manner using mechanical connectors to allow easy interchange of one shaft for another on the head.

The shaft 106 also may be made from any suitable or desired materials, including conventional materials known and used in the art, such as graphite based materials, composite or other non-metal materials, steel materials (including stainless steel), aluminum materials, other metal alloy materials, polymeric materials, combinations of various materials, and the like. Also, the grip or handle 107 may be attached to, engaged with, and/or extend from the shaft 106 in any suitable or desired manner, including in conventional manners known and used in the art, e.g., using adhesives or cements; via welding, soldering, brazing, or the like; via mechanical connectors (such as threads, retaining elements, etc.); etc. As another example, if desired, the grip or handle 107 may be integrally formed as a unitary, one-piece construction with the shaft 106. Additionally, any desired grip or handle materials may be used without departing from this disclosure, including, for example: rubber materials, leather materials, rubber or other materials including cord or other fabric material embedded therein, polymeric materials, and the like.

Aspects of the disclosure relate to particular structures of the golf club head 102. According to aspects of the disclosure, the golf club head 102 may be constructed in any suitable or desired manner and/or from any suitable or desired materials without departing from this disclosure, including from conventional materials and/or in conventional manners known and used in the art. For example, the club head 102 and/or its various parts may be made by forging, casting, molding, and/or using other techniques and processes, including techniques and processes that are conventional and known in the art.

As seen in FIG. 1, the golf club head 102 may include a golf club head body 108 and a ball striking face 109. According to aspects of the disclosure, the ball striking face 109 may be integral with the golf club head body 108. According to other aspects of the disclosure, the ball striking face 109 may be separable from the golf club head body 108 (e.g., a face plate), and, further, configured to be engaged with the golf club head body 108 (e.g., by press fitting, bonding with adhesives or cements, welding (e.g., laser welding), soldering, brazing, or other fusing techniques, mechanical connectors, etc.). Further, according to aspects of the disclosure, the golf club head body 102 may be comprised of steel. For example, the golf club head body 102 may comprise carbon steel (e.g., 1020 or 1025 carbon steel). Of course, other materials may be used as well. For example, other metals, alloys, polymers, plastics, etc. or combinations thereof, may be used as desired.

Further, according to aspects of the disclosure, the golf club head 102 may be a blade type iron golf club head. According to other aspects the golf club head body 102 may be a perimeter weighted and/or cavity back type golf club head or other iron-type golf club head structure. For example, a perimeter weighted and/or cavity back type golf club head including the golf club head body 102 according to aspects of the disclosure, may include a rear surface opposite the ball striking face 109 which includes a perimeter weighting member extending rearward from the ball striking face and along at least a portion of a circumferential area of the golf club head body. According to aspects of the disclosure, a wide variety of overall club head constructions are possible without departing from this disclosure. For example, it is noted that the dimensions and/or other characteristics of a golf club head 102 according to examples of this disclosure may vary significantly without departing from the disclosure. For example, according to aspects of the disclosure, the golf club head 102 may be used iron-type golf clubs, such as wedges (e.g., pitching wedges, lob wedges, gap wedges, sand wedges, etc.), 0 through 10 irons, driving irons, iron-type hybrid clubs, etc.

As seen in FIG. 1, according to aspects of the disclosure, the ball striking face 109 may have a generally trapezoidal shape which extends between a crown and a sole of the golf club head 102 and, further, extends substantially between a toe and a heel of the golf club head 102. Of course, the ball striking face 109 may have other configurations as well.

According to aspects of the disclosure, and as seen in FIGS. 1 and 3, the ball striking face 109 may include grooves **109*a*. According to aspects of the disclosure, the plurality of grooves 109*a* may extend generally horizontally across the ball striking face 109. According to aspects of the disclosure, the grooves 109*a* may extend partially, substantially, or completely across the ball striking face 109. According to aspects of the disclosure, the number of grooves 109*a* and/or the dimensions of each of the grooves 109*a* may be varied as desired. For example, according to aspects of the disclosure, the grooves 109*a* may have a relatively square or rectangular cross-sectional shape. Alternatively, the portions of the ball striking face 109 defining the grooves 109*a* may be tapered such that the cross-sectional shape of the grooves 109*a* may resemble a "V" or "U" shape, wherein the hole defined by a groove 109*a* becomes narrower as it extends toward the club head body 108. The grooves 109*a* may interact with the dimpled surface of the golf ball during the impact of the golf club head 102 with a golf ball (e.g., during a golf swing) and affect the aerodynamics of the golf ball during the golf shot. For example, the grooves 109*a*** may cause a spin (e.g., back spin) of the golf ball during the golf shot.

According to aspects of the disclosure, the golf club head 102 may include at least one piezoelectric member 120 associated therewith. A piezoelectric member may include an element with piezoelectric properties. It is noted that an element with piezoelectric properties may generate an electrical voltage when a mechanical strain or stress is applied. Further, conversely, the element with piezoelectric properties may deform mechanically when an electric field is applied. For example, according to aspects of the disclosure, an electric field may be applied to the piezoelectric member 120 which causes a change in the configuration (e.g., the size or dimensions) of the piezoelectric member 120. For example, the size of the piezoelectric member 120 may increase (e.g., "grow") or decrease ("shrink") when an electric field is applied. Further, the size of the piezoelectric member 120 may tend to return to their original shape when the electric field is removed. Further, the amount the piezoelectric member 120 deforms (e.g., the amount the piezoelectric member 120 increases or decreases in size) during the time the electric field is applied may be dependent upon the strength of the electric field. For example, according to aspects of the disclosure, the piezoelectric member 120 may deform by a first amount (e.g., increase or decrease by a first size) if a first voltage is applied and may deform by a second, larger amount (e.g., increase or decrease by a second, larger size) if a second larger voltage is applied.

Therefore, according to aspects of the disclosure, one or more piezoelectric members 120 may be used in a the golf club head 102 to control and selectively alter various attributes, characteristics or properties of the iron-type golf club head. For example, according to aspects of the disclosure, one or more piezoelectric members 120 may be incorporated into the golf club heads 102 and an electric field may be applied to the one or more piezoelectric members 120 to selectively alter various attributes, characteristics or properties of the iron-type golf club head. It is noted that according to aspects of the disclosure, attributes may include mechanical or physical properties of the golf club head. For example, the attributes may include the configuration of the grooves in the iron-type golf club head (e.g., the depth, volume, shape, angle, etc., of the grooves); the internal stress, stiffness or hardness behind the ball striking face of the golf club head; the loft angle of the golf club head; etc. Further, it is noted that attributes may affect the trajectory of the golf ball after impact with the golf club head (e.g., by affecting how the golf ball leaves off the ball striking face of the golf club head). For example, the attributes may affect the trajectory of the golf ball after impact with the golf club head by affecting the backspin of the golf ball, the lofted flight of the golf ball, etc.

According to aspects of the disclosure any element with piezoelectric properties may be used as the piezoelectric member 120. For example, according to aspects of the disclosure, polymers having piezoelectric properties may be used as the piezoelectric member 120. By way of example, polyvinylidine diflouride (PVDF) is an element with piezoelectric properties that may be used as the piezoelectric member 120 in accordance with aspects of the disclosure.

According to aspects of the disclosure, and as seen in FIG. 3, the golf club head 100 may include a controller 122 for activating the piezoelectric member 120 associated with the golf club head 120. For example, as shown in FIG. 3, the shaft 107 may be configured to support the controller 122. According to aspects of the disclosure, the controller 122 may be operably connected to the piezoelectric member 120. For example, the controller 122 may include wires which transmit the electric field (e.g., via an electric current) from a power source (e.g., a battery) to the piezoelectric member 120. Other various types of conductors can also be used.

According to aspects of the disclosure, the controller 122 may include a switch, a knob, or dial, 124 which may be configured to rotate to control the electric field applied to the piezoelectric material 120. For example, the knob 124 may be configured to be rotated from a first (e.g., "off") position, wherein no electric field is generated, to a second (e.g., "on") position, wherein an electric field is generated and applied to the piezoelectric material 120. According to aspects of the disclosure, upon the electric field being generated and applied to the piezoelectric material 120, the size of the piezoelectric member 120 may be increased or decreased as discussed above. Conversely, when the knob 124 is rotated back to the off position and the electric field is removed, then as discussed above, the size of the piezoelectric member 120 may decrease or increase back to its original size.

Further, according to aspects of the disclosure, the controller 122 may be configured to vary the strength of the electric field (e.g., the amount of voltage) applied to the piezoelectric material 120. For example, according to aspects of the disclosure, the knob 124 may be configured to rotate between various positions, which, in turn, increase or decrease the strength of the electric field. For example, one position to which the knob 124 may be rotated may correspond to a voltage of 1.5V, a second position to which the knob 124 may be rotated may correspond to a voltage of 3.0V, etc. In this way, the golfer may selectively adjust the size of the piezoelectric material 120 and, thereby, selectively alter and control various attributes, characteristics or properties of the iron-type golf club head. It is noted that the above voltages are merely illustrative and other voltages may be applied as desired.

As seen in FIG. 3, the shaft 106 may include a compartment configured to receive a battery or other power source. Further, according to aspects of the disclosure, the controller 122 may be configured to be connected to the one or more power source (e.g., through one or more of leads connected to the battery or power source) in order to apply the electric field to the piezoelectric material 120. According to aspects of the disclosure, a portion of the shaft 106 (e.g., the handle 107) may be removeably engaged with the remainder of the shaft 106 (e.g., through threads or other mechanical connectors) in order to allow access to the battery or power supply (e.g., to insert or replace the battery or power supply).

According to aspects of the disclosure, the piezoelectric member 120 may be activated by the hand or grip of the golfer when the golfer grips the golf club 100. For example, according to aspects of the disclosure, the golf club 100 may include a button or switch (e.g., a button or switch positioned at or near the handle 107) that is depressed or otherwise activated (e.g., a switch activated by pressure) when the golf grips the golf club 100. By activating the button, the electric field may be applied to the piezoelectric member 120 (e.g., through wires running through the shaft 106) to deform the piezoelectric member 120 (e.g., to increase or decrease the size of the piezoelectric member 120). For example, when the button is depressed, a circuit may be completed through which the electric field may be applied to the piezoelectric member 120. Further, it is noted that according to such an embodiment of the golf club 100, the knob 124 may be incorporated to modify the voltage applied to the piezoelectric member 120 as described above.

Figure 13:
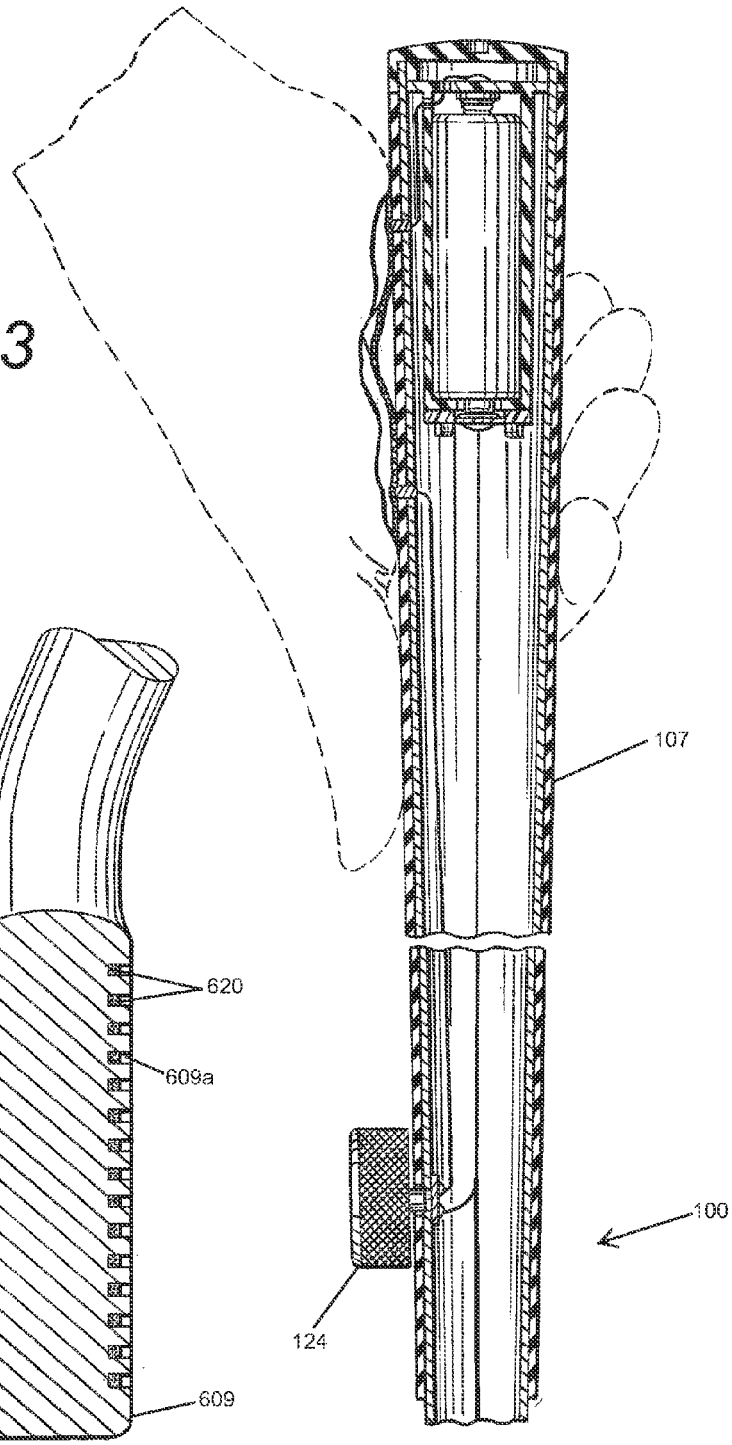
FIG. 13 is a partial cross-sectional schematic view of an activation system associated with the golf club shown in FIG. 3.

Alternatively, the golfer may wear a glove which could include an external power source or other structure designed to complete a circuit to activate the piezoelectric member. FIG. 13 shows a cross-sectional view of the golf club 100 in which an illustrative embodiment such a controller 122 is configured. As seen in FIG. 13, according to aspects of the disclosure, the golf club 100 may include exposed portions (e.g., a switch, electrical lead, etc. positioned at or near the handle 107). The glove may include a material that will serve to complete a circuit that activates the piezoelectric member 120. For example, the glove may include a conducting material positioned on the exterior of the palm of the glove. Thereby, when the golfer grips the handle, the conducting material engages the exposed leads and completes the circuit through which the electric field may be applied to the piezoelectric member 120. Conversely, the golfer releases the handle, the circuit is opened and, consequently, the electric field may be removed from the piezoelectric member 120.

According to particular aspects of the disclosure, the glove may contain the power source (e.g., a battery) instead of (or in addition to) the golf club 100. For example, the glove may contain a battery through which the electric field may be applied to the piezoelectric member 120 when the golfer grips of the handle and the conducting material engages the exposed leads and completes the circuit. According to aspects of the disclosure, the battery may be in contact with the leads in order to complete the circuit and apply the electric field to the piezoelectric member 120. Alternatively, the battery may contact wires or other conducting material positioned on the exterior of the glove, which in turn contacts the leads in order to complete the circuit and apply the electric field to the piezoelectric member 120.

FIGS. 4A, 4B, 4C, 5A and 5B show various views of the illustrative embodiment of the golf club head 102 according to aspects of the disclosure. According to aspects of the disclosure and as illustrated in the embodiment shown in FIGS. 1, 3, 4A, 4B, 4C, 5A and 5B, piezoelectric material may be configured within the golf club head 102 to control the depth of the grooves 109*a* of the golf club head 102. Hence, as will be discussed below, according to aspects of the disclosure, the piezoelectric member 120 may be used to selectively control and adjust the depth of the grooves of the golf club head 102 and, thereby, the amount of backspin imparted to the golf ball by the golf club head 102 and also the launch angle and ball speed.

Figure 4A:
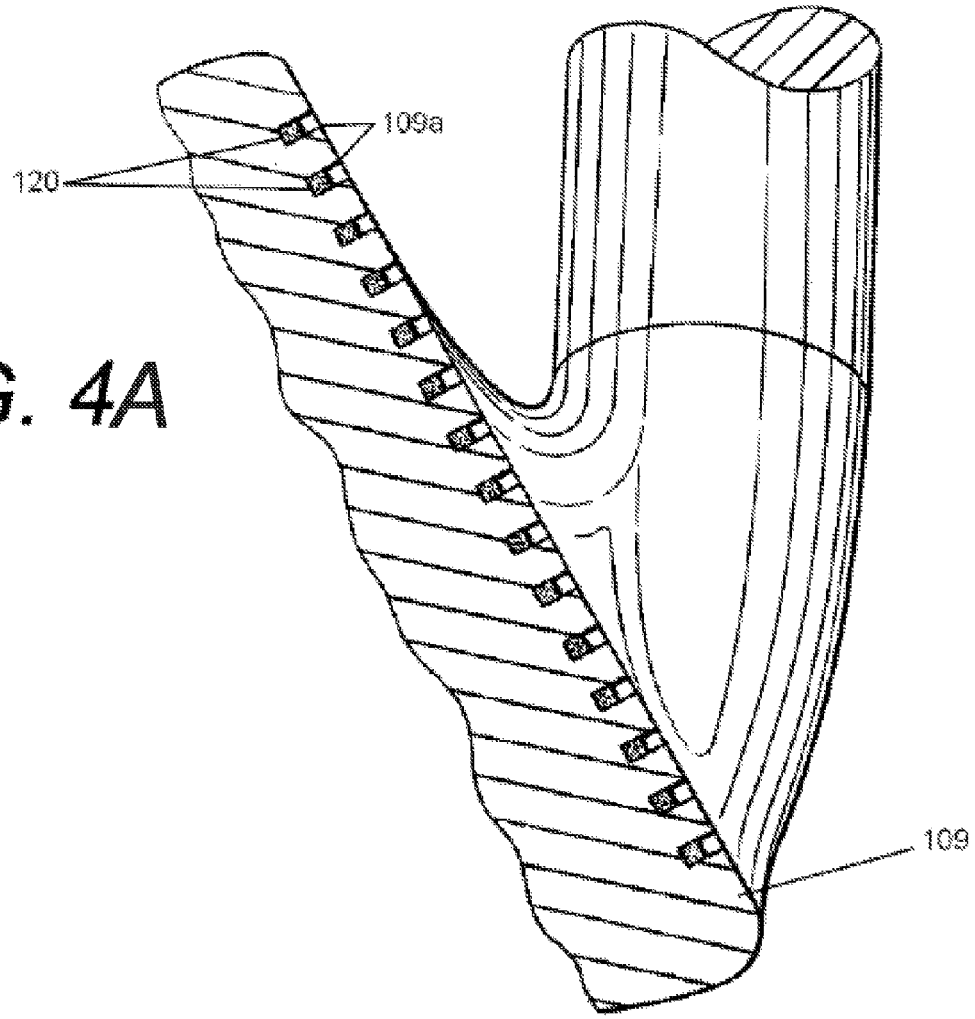
FIG. 4A is a partial cross-sectional view of the golf club head body taken along lines 4-4 shown in FIG. 1.
Figure 4B:
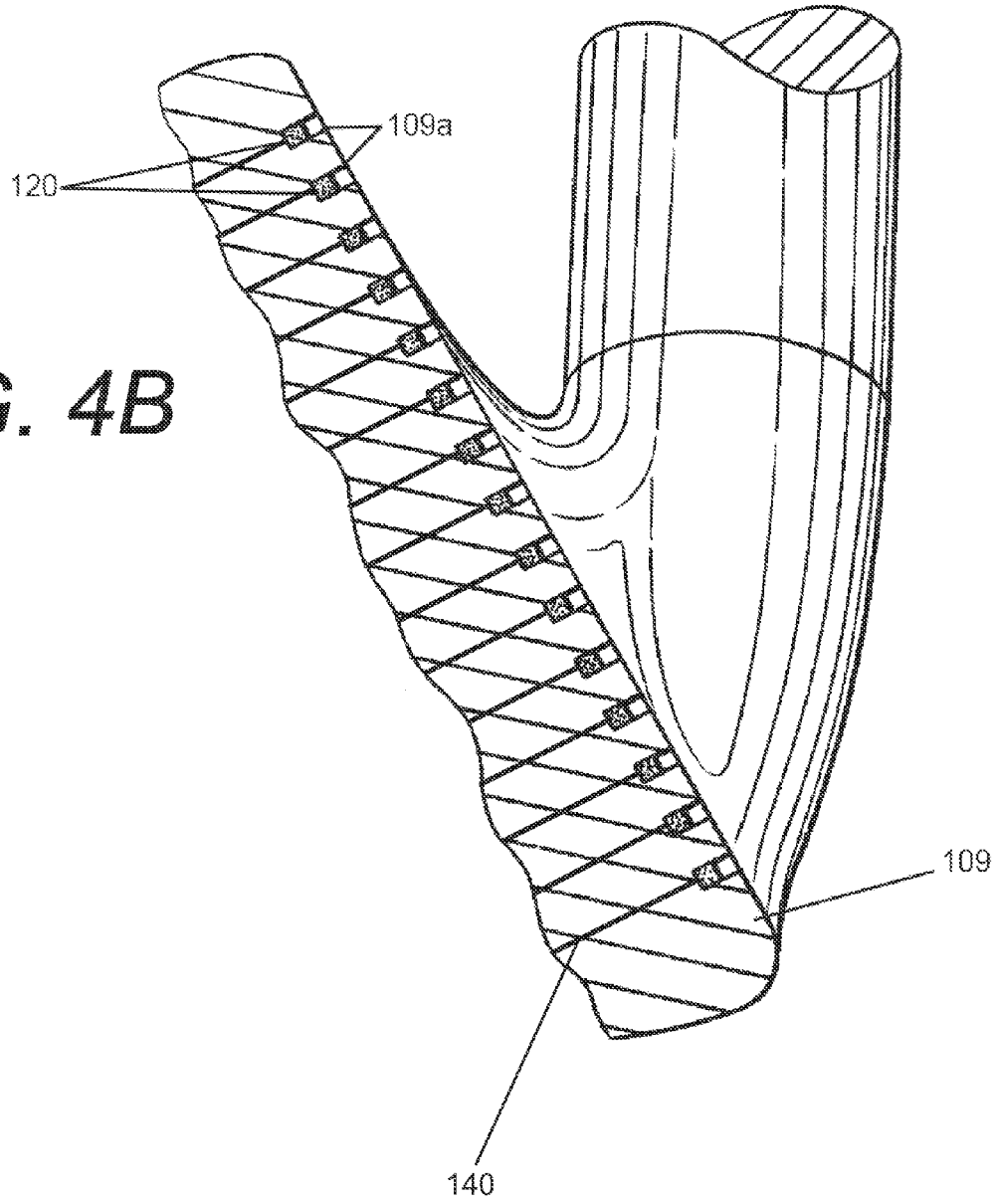
FIG. 4B is a partial cross-sectional view of the golf club head body shown in FIG. 1.
Figure 4C:
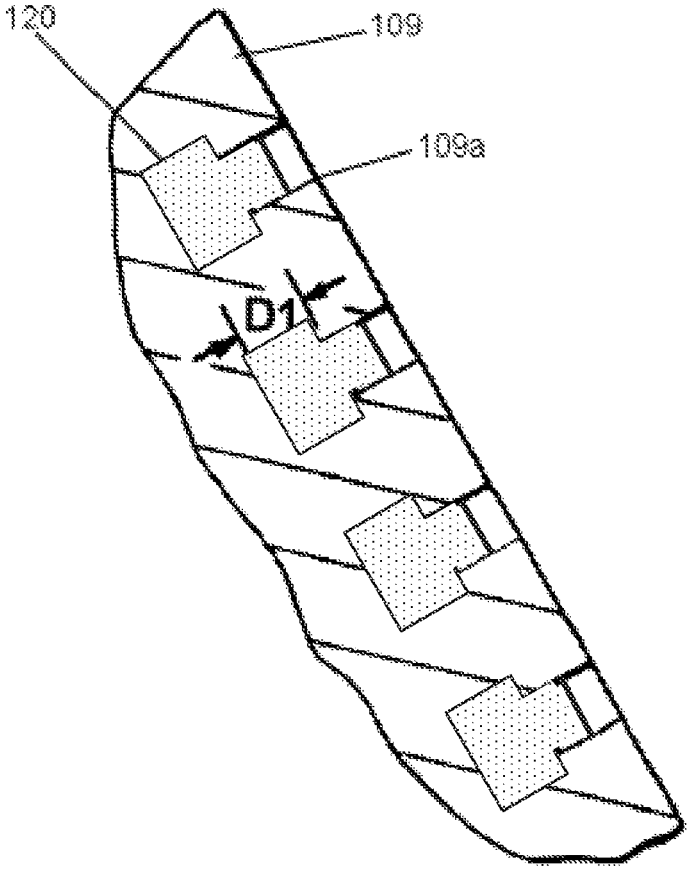
FIG. 4C is a partial cross-sectional view of the golf club head body according to an embodiment of the disclosure.
Figure 5A:
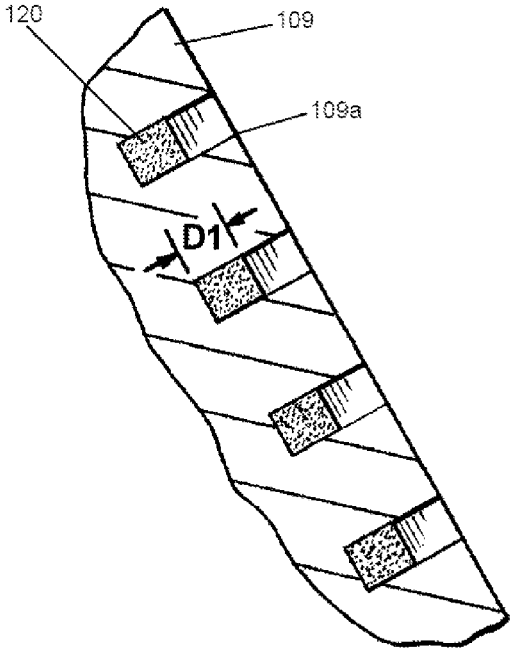
FIG. 5A is a partial enlarged cross-sectional view of the golf club head body shown in FIG. 4A, and showing a piezoelectric member in a first position.
Figure 5B:
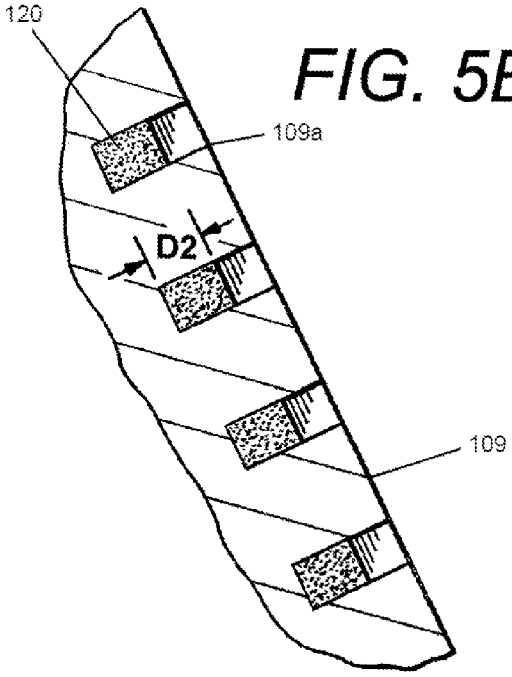
FIG. 5B is another partial enlarged cross-sectional view of the golf club head body shown in FIG. 5A, and showing the piezoelectric member in a second position.

Specifically, FIG. 4A is a partial cross-sectional view of the golf club head body taken along lines 4-4 shown in FIG. 1. FIG. 4B is a partial cross-sectional view of the golf club head body. FIG. 4C is a partial cross-sectional view of the golf club head body according to another embodiment of the disclosure. FIG. 5A is a partial enlarged cross-sectional view of the golf club head body shown in FIG. 4, and showing a piezoelectric member in a first position. FIG. 5B is another partial enlarged cross-sectional view of the golf club head body shown in FIG. 5A, and showing the piezoelectric member in a second position.

Figure 2:
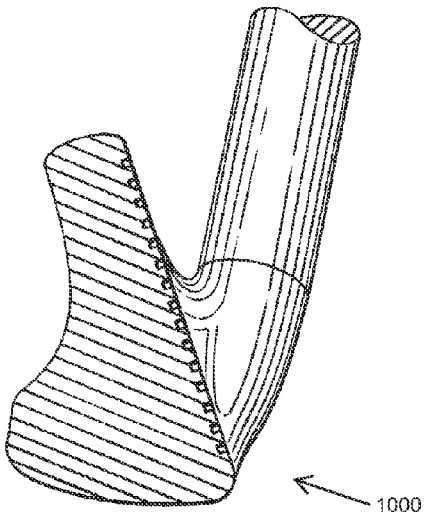
FIG. 2 PRIOR ART
FIG. 2 is a side elevation view of a prior art golf club head with a portion of the head shown in cross-section.

In order to describe the features of the illustrative golf club head 102, a figure of a conventional golf club head is provided for reference at FIG. 2. FIG. 2 is a partial cross-sectional view of a conventional golf club head body 1000. As seen in FIG. 2, the conventional golf club head has grooves which extend in a horizontal direction (i.e., a heel to toe direction) across the golf club head body.

In contrast to the conventional golf club head shown in FIG. 2, the illustrative golf club head 102 shown in FIG. 4A, may include one or more piezoelectric members 120. For example, as seen in FIG. 4A, the piezoelectric members 120 may be positioned to extend through the grooves 109*a* in the ball striking face 109 of the golf club head 102. For example, the piezoelectric members 120 may be configured as strips which extend substantially or entirely through the length of grooves 109*a* (e.g., a heel to toe direction) in the ball striking face 109 of the golf club head 102. It is noted that the piezoelectric members 120 may have other configurations as well. For example, the piezoelectric members 120 may be connected by a continuous plane of piezoelectric material parallel to the ball striking face 109 (e.g., a face plate). For example, the continuous plane of piezoelectric material may be positioned at the rear of the piezoelectric members 120 so as to connect the piezoelectric members 120. The continuous plane of piezoelectric material may extend throughout some, or all, of the golf club head 102 at a position behind ball striking face 109.

As described above, according to aspects of the disclosure, the electric field may be applied to the piezoelectric member 120 through wires running through the shaft 106 to deform the piezoelectric member 120. FIGS. 3 and 13 show such illustrative embodiments. Further, FIG. 4B is an illustrative embodiment of such a structure according to aspects of the disclosure. As seen in cross-sectional view shown in FIG. 4B, each of the piezoelectric member 120 may be connected to a lead or wire 140 through which the electric field may be applied to the piezoelectric member 120. The lead or wire 140 may be connected to the battery in the handle 107, such as shown in FIG. 3. For example, each lead or wire 140 may be a branch of the wire that runs along the shaft of the golf club 100 as seen in FIG. 3. It is understood that the lead or wire 140 may be employed in various alternative configurations that will allow a suitable electrical field to be applied to the piezoelectric member. It is further understood that the lead or wire 140 can take various conductive member configurations as necessary to impart the electrical field. It is noted that for clarity purposes, leads or wires 140 connected to piezoelectric member 120 may not be shown in various other cross-sectional views throughout the application.

It is noted that the piezoelectric members may be engaged with the golf club head 102 by any viable means, such as: adhesives, cements, welding, soldering, etc. Alternatively, the piezoelectric members may be formed integrally with the golf club head 102. According to aspects of the disclosure piezoelectric members may be injected into the golf club head 102. For example, the piezoelectric material may be injected into cavities in the golf club head 102 that are configured to receive such piezoelectric material. Further, according to aspects of the disclosure the golf club head 102 and the piezoelectric members may be configured so that the engagement between the golf club head 102 and the piezoelectric members retains the piezoelectric members within the golf club head 102. For example, FIG. 4C is an illustrative embodiment of such a structure according to aspects of the disclosure. As seen in FIG. 4C, each of the piezoelectric member 120 may be configured with a dovetail shape. Further, the golf club head 102 may include a corresponding cavity configured to engage with the dovetail shape of the piezoelectric member 120. Thereby, such engagement between the golf club head 102 and the piezoelectric members 120 retains the piezoelectric members within the golf club head 102. It is noted that other structures of the piezoelectric material and cavities may be used as well (e.g., other shapes for retaining the piezoelectric material within the golf club head 102).

FIG. 5A illustrates the piezoelectric members 120 in the golf club head 102 in a first position (e.g., an original state) when no electric field has been applied to the piezoelectric members 120. As seen FIG. 5A, the piezoelectric members 120 have a first size which includes a depth of D1. In contrast, FIG. 5B illustrates the piezoelectric members 120 in the golf club head 102 in a second position (e.g., a deformed state) when an electric field has been applied to the piezoelectric members 120. As seen FIG. 5B, the piezoelectric members 120 have a second size which includes a depth of D2 which is greater than D1. Hence, the volume of the grooves 109*a* of the golf club head is reduced. Therefore, it is understood, that according to aspects of the disclosure, the volume of the grooves 109*a* of the golf club head 102 may be controlled (e.g., increased and deceased) by manipulating the piezoelectric members 120 positioned in the grooves 109*a* in the ball striking face 109 of the golf club head 102 (e.g., by applying an electric field to the piezoelectric members 120).

It is noted that the grooves 109*a* may affect the friction created between the ball striking face 109 and the golf ball. For example, when the ball striking face 109 contacts the golf ball during a golf swing the grooves 109*a* can impact (e.g., grip or "bite into") the golf ball exerting a downward force against the golf ball. The downward force may cause the golf ball to have backspin when the golf ball leaves the ball striking face 109. The dimensions of the grooves (e.g., the shape, height (e.g., in the sole to crown direction), depth, (e.g., in the face to rear direction), etc.) may affect the amount of friction applied to the golf ball and, thereby, the amount of backspin the golf ball has when it leaves the ball striking face 109 during the golf shot. For example, larger and deeper grooves may have more grip and also prevent debris (e.g., dirt, sand, grass, etc.) from being caught between the golf ball and the ball striking face, thereby let the groove contact the golf ball.

Therefore, according to aspects of the disclosure, and as seen by comparing FIG. 5A with FIG. 5B, by manipulating the piezoelectric members 120 positioned in the grooves 109*a* of the ball striking face 109 of the golf club head 102, the volume of the grooves 109*a* of the golf club head may be increased or decreased and, as a result, more or less backspin may be created during impact of the golf club head 102 with the golf ball during a golf swing. Further, it is noted that while FIGS. 5A and 5B represent two sizes of the piezoelectric members 120 other voltages could provide other sizes as well. For example, FIG. 5A may represent an original state wherein no voltage is applied to the piezoelectric members 120 and the piezoelectric members 120 are configured such that D1 is 0.5 mm. Further, FIG. 5B may represent a state wherein 1.5V are applied to the piezoelectric members 120 and the piezoelectric members 120 are deformed such that D2 is 0.6 mm. Additionally, while not shown, it is noted that according to aspects of the disclosure, a larger voltage (e.g., 3.0V) could be applied to the piezoelectric members 120 and the piezoelectric members 120 may be deformed even further to a point wherein the depth (e.g., D3) is 0.7 mm. Of course, other voltages and dimensions are contemplated according to aspects of the disclosure and may be used as desired.

While the above described embodiment refers to a configuration wherein the piezoelectric members 120 have a first size which includes a depth of D1 when no electric field is applied and a second size which includes a depth of D2 which is greater than D1 when an electric field is applied, it is noted that other embodiments are within the scope of the disclosure. For example, according to other aspects of the disclosure, the piezoelectric members 120 have a first size which includes a depth of D1 when no electric field is applied and a second size which includes a depth of D2 which is smaller than D1 when an electric field is applied. In other words, the piezoelectric members 120 may "shrink" when the electric field is applied. Hence, the volume of the grooves 109*a* of the golf club head is increased.

According to particular embodiments of the disclosure, the change in depth of the piezoelectric member may be in the range of 0.1 mm. For example, the depth D1 of the piezoelectric members 120 may be 2.0 mm and the depth D2 may be 1.9 mm. Further, according to other particular embodiments of the disclosure, the change in depth of the piezoelectric member may be smaller (e.g., in a range of a tenth of a millimeter or less). For example, the depth D1 of the piezoelectric members 120 may be 0.7 mm and the depth D2 may be 0.693 mm.

Figure 6A:
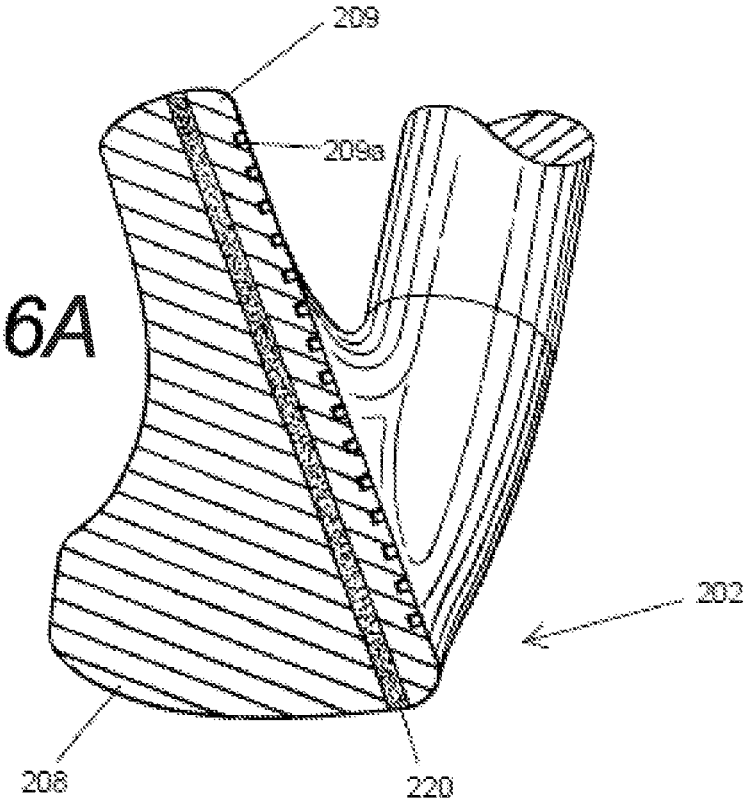
FIG. 6A is a cross-sectional view of an alternative embodiment of a golf club head in accordance with the present disclosure, and having a piezoelectric member.

According to aspects of the disclosure, piezoelectric material may be incorporated into a golf club head in other ways to selectively control or adjust other attributes of the golf club head. For example, according to aspects of the disclosure, piezoelectric material may be configured within the golf club head to control the stiffness, hardness, or internal stress, behind the ball striking face of the golf club head. For example, FIG. 6A illustrates an alternative embodiment of a golf club head body 202 according to aspects of the disclosure. Specifically, FIG. 6A shows a cross-sectional view of an illustrative embodiment of the golf club head 202 according to aspects of the disclosure.

It is noted that several features of the embodiment shown in FIG. 6A are similar to the embodiment described above and, therefore, for the sake of brevity will not be elaborated on in detail here. However, it is noted that according to aspects of the disclosure and as illustrated in the embodiment shown in FIG. 6A, piezoelectric material may be configured within the golf club head 202 to control the stiffness, hardness, or internal stress, behind the ball striking face 209 of the golf club head 202. Hence, as will be discussed below, according to aspects of the disclosure, the piezoelectric material may be used to selectively control and adjust the dampening effect of the golf club head 202 during a golf shot.

As seen in the illustrative embodiment shown in FIG. 6A, according to aspects of the disclosure, the golf club head 202 may include a piezoelectric member 220 that extends behind the ball striking face 209. For example, as seen in FIG. 6A, the piezoelectric member 220 may be configured as a sheet or plate and positioned to extend substantially or entirely behind the ball striking face 209 of the golf club head 202. Of course, if desired, the piezoelectric member 220 may be configured and positioned to extend behind a portion, or separate portions, of the ball striking face 209 (e.g., behind the sweet spot of the ball striking face 209). According to aspects of the disclosure, the depth or thickness of the piezoelectric member 220 may be in the range of 0.5-0.7 mm.

FIG. 6A illustrates the piezoelectric member 220 in the golf club head 202 in a first position (e.g., an original state) when no electric field has been applied to the piezoelectric member 220. As seen FIG. 6, the piezoelectric member 220 has a first depth, or thickness. Similarly, to the above described embodiment, when an electric field is been applied to the piezoelectric member 220, the piezoelectric member 220 in the golf club head 202 will deform. For example, the piezoelectric member 220 may deform to a second size which includes a depth, or thickness, which is greater than depth or thickness of the first state shown in FIG. 6A. Hence, the stiffness, hardness or internal stress behind the ball striking face 209 is increased. Therefore, it is understood, that according to aspects of the disclosure, the stiffness, hardness or internal stress behind the ball striking face 209 may be controlled (e.g., increased and deceased) by manipulating the piezoelectric member 220 positioned behind the ball striking face 209 of the golf club head 202 (e.g., by applying an electric field to the piezoelectric member 220).

Providing a piezoelectric member 220 behind the ball striking face 209, may affect the golf club head's ability to dampen potential vibrations caused during impact. Thereby, providing a piezoelectric member 220 behind the ball striking face 209, may, in turn, control the "feel" of the golf club head 202. For example, by increasing the hardness or internal stress behind the ball striking face 209, the dampening ability of the golf club head 202 may be increased. Hence, increasing the hardness, or internal stress, behind the ball striking face 209, may increase the feel of the golf club head 202.

Therefore, according to aspects of the disclosure, by manipulating the piezoelectric member 220 positioned behind the ball striking face 209 of the golf club head 202, the stiffness, hardness, or internal stress, behind the ball striking face 209 may be increased or decreased and, as a result, the dampening effect of the golf club may be increased or decreased. Further, it is noted that, as described above with regard to the first embodiment, different voltages may be applied as desired to fine tune the stiffness, hardness, or internal stress, behind the ball striking face 209 as desired.

Figure 6B:
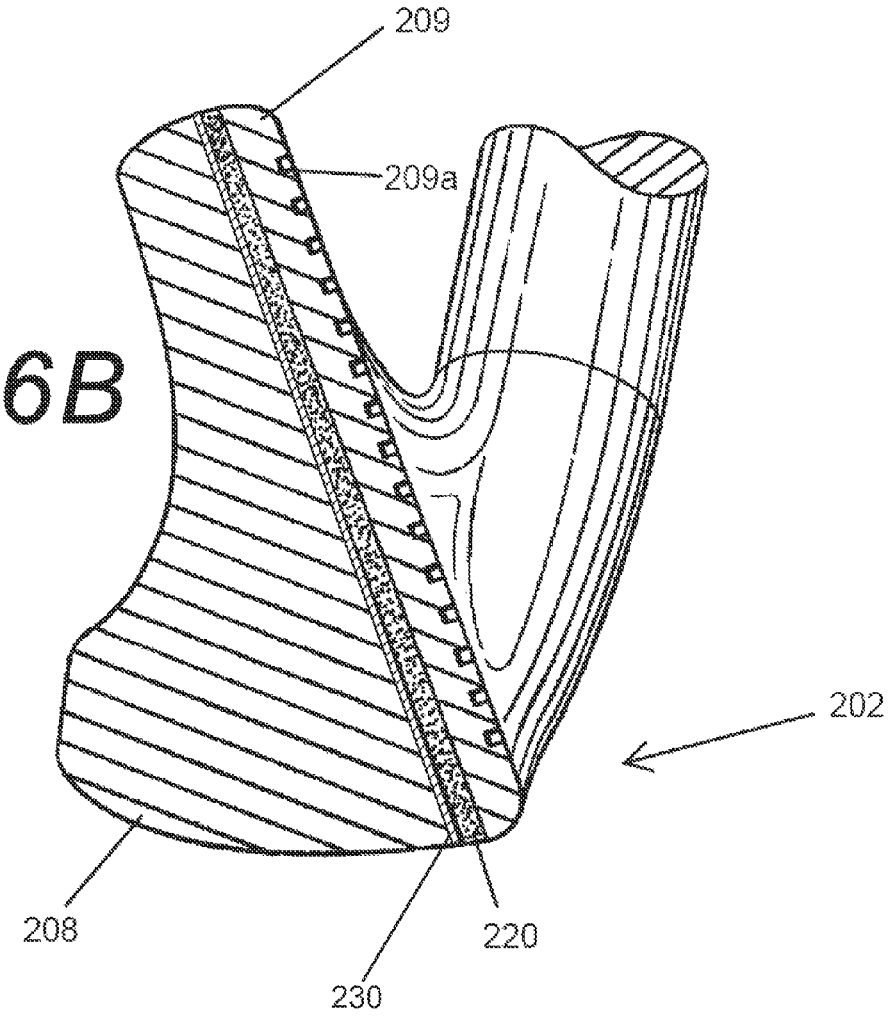
FIG. 6B is a cross-sectional view of an alternative embodiment of a golf club head in accordance with the present disclosure, and having a piezoelectric member.

According to aspects of the disclosure, the golf club head 102 may include a cavity into which the piezoelectric member 220 may intrude when the piezoelectric member 220 deforms. FIG. 6B illustrates such an embodiment which includes a cavity 230 configured to receive the piezoelectric member 220 when the piezoelectric member 220 deforms. It is noted that each of the embodiments described in the application may include one or more cavities corresponding to each piezoelectric member 220 in a golf club head 102, wherein the one or more cavities are configured to receive the respective piezoelectric members 220 when the piezoelectric members 220 deform.

While the above described embodiment refers to a configuration wherein the piezoelectric member 220 have a first size when no electric field is applied and a second size which is greater than the first size when an electric field is applied, it is noted that other embodiments are within the scope of the disclosure. For example, according to other aspects of the disclosure, the piezoelectric member 220 have a first size when no electric field is applied and a second size which is smaller than the first size when an electric field is applied. In other words, the piezoelectric member 220 may "shrink" when the electric field is applied. Hence, the stiffness, hardness or internal stress behind the ball striking face 209 is decreased.

Figure 7:
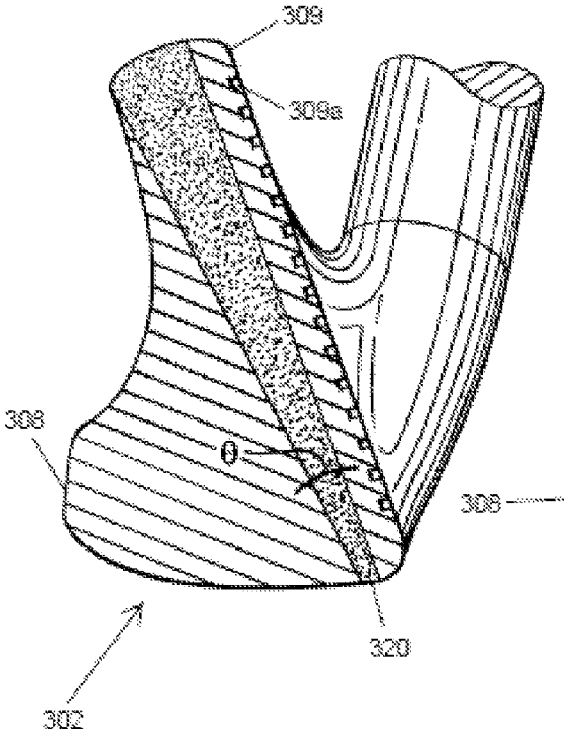
FIG. 7 is a cross-sectional view of an alternative embodiment of a golf club head in accordance with the present disclosure, and showing a piezoelectric member in a first position.
Figure 8:
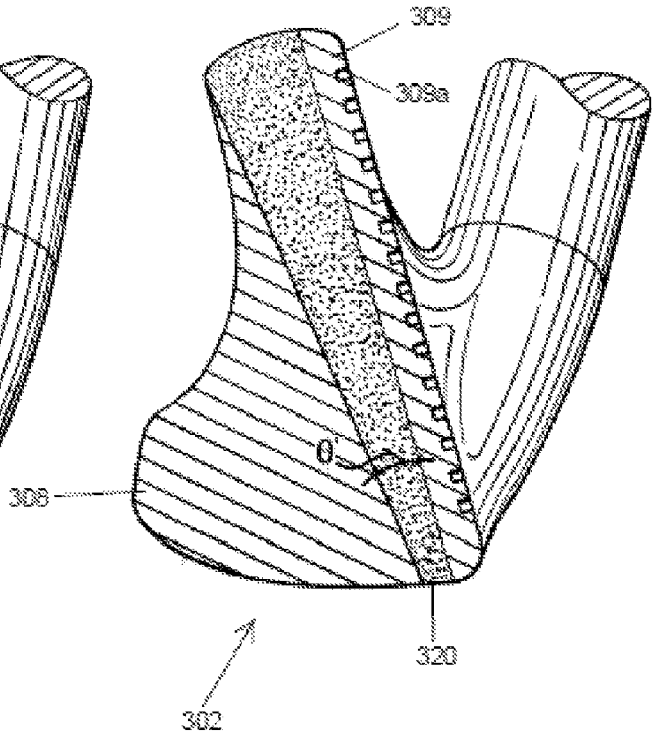
FIG. 8 is another cross-sectional view of the golf club head shown in FIG. 7, and showing the piezoelectric member in a second position.

According to aspects of the disclosure, piezoelectric material may be incorporated into a golf club head still in other ways to selectively control or adjust other attributes of the golf club head. For example, according to aspects of the disclosure piezoelectric material may be configured within the golf club head to control the loft of the golf club head. For example, FIGS. 7-8 illustrate an alternative embodiment of a golf club head body 302 according to aspects of the disclosure. Specifically, FIG. 7 shows a cross-sectional view of an illustrative embodiment of the golf club head 302 according to aspects of the disclosure wherein a piezoelectric member 320 is in a first position. FIG. 8 shows a cross-sectional view of the illustrative embodiment of the golf club head 302 according to aspects of the disclosure wherein the piezoelectric member 320 is in a second position.

It is noted that several features of the embodiment shown in FIGS. 7 and 8 are similar to the embodiments described above and, therefore, for the sake of brevity will not be elaborated on in detail here. However, it is noted that according to aspects of the disclosure and as illustrated in the embodiment shown in FIGS. 7 and 8, the piezoelectric member 320 may be configured within the golf club head 302 to selectively control and adjust the loft of the golf club head 302. Hence, as will be discussed below, according to aspects of the disclosure, the piezoelectric member 302 may be used to selectively control and adjust features of the golf club head 302 including the loft of the golf club head and the dampening effect the golf club head 302 has on the golf shot.

As seen in the illustrative embodiment shown in FIGS. 7 and 8, according to aspects of the disclosure, the piezoelectric member 320 may extend behind the ball striking face 309. For example, as seen in FIGS. 7 and 8, the piezoelectric member 320 may be configured as a sheet or plate and positioned to extend substantially or entirely behind the ball striking face 309 of the golf club head 302. Of course, if desired, the piezoelectric member 320 may be configured and positioned to extend behind a portion, or separate portions, of the ball striking face 309 (e.g., behind the sweet spot of the ball striking face 309). According to aspects of the disclosure, the depth or thickness of the piezoelectric member 320 may vary with the length or height of the piezoelectric member 320. For example, as seen in FIGS. 7 and 8, the thickness of the piezoelectric member 320 is greater at the upper portion of the piezoelectric member 320 than the lower portion of the piezoelectric member 320. For example, the upper portion of the piezoelectric member 320 may have a thickness in the range of 1.0-1.4 mm and the lower portion of the piezoelectric member 320 may have a thickness in the range of 0.5-0.7 mm. Further, as seen in FIGS. 7 and 8, and as will be discussed below, the piezoelectric member 320 may include an angled configuration.

FIG. 7 illustrates the piezoelectric member 320 in the golf club head 302 in a first position (e.g., an original state) when no electric field has been applied to the piezoelectric member 320. As seen in FIG. 7, the piezoelectric member 320 has a first configuration which includes an angle Ø. In contrast, FIG. 8 illustrates the piezoelectric member 320 in the golf club head 302 in a second position (e.g., a deformed state) when an electric field has been applied to the piezoelectric member 320. As seen in FIG. 8, the piezoelectric member 320 has a second configuration which includes an angle Ø' which is greater than Ø. Hence, the angle of loft, or loft, of the golf club head 302 may be increased. Therefore, it is understood, that according to aspects of the disclosure, the loft of the golf club head 302 may be controlled (e.g., increased and decreased) by manipulating the piezoelectric member 320 positioned behind the ball striking face 309 of the golf club head 302 (e.g., by applying an electric field to the piezoelectric members 320).

Therefore, according to aspects of the disclosure, and as seen by comparing FIG. 7 with FIG. 8, by manipulating the piezoelectric members 320 positioned behind the ball striking face 309 of the golf club head 302, the loft of the golf club head 302 may be increased or decreased and as a result, more or less loft may be imparted to the golf ball during impact of the golf club head 302 with the golf ball during a golf swing. Further, it is noted that while FIGS. 7 and 8 represent two configurations of the piezoelectric members 320, other voltages may be applied to provide other angles as well. For example, FIG. 7 may represent an original state wherein no voltage is applied to the piezoelectric member 320 and the piezoelectric member 320 is configured such that Ø is 15°. Further, FIG. 8 may represent a state wherein 1.5V are applied to the piezoelectric member 320 and the piezoelectric member 320 is deformed such that Ø' is 16°. Additionally, while not shown, it is noted that according to aspects of the disclosure, a larger voltage (e.g., 3.0V) could be applied to the piezoelectric member 320 and the piezoelectric member 320 may be deformed even further to a point wherein the angle (e.g., Ø") is 17°. Of course, other voltages and angles are contemplated according to aspects of the disclosure and may be used as desired. For example, according to aspects of the disclosure, an angle may deform by 5° or less.

While the above described embodiment refers to a configuration wherein the piezoelectric members 320 define a first angle Ø when no electric field is applied and a second angle Ø' which is greater than first angle Ø when an electric field is applied, it is noted that other embodiments are within the scope of the disclosure. For example, according to other aspects of the disclosure, the piezoelectric members 320 define a first angle Ø when no electric field is applied and a second angle Ø' which is less than first angle Ø when an electric field is applied. In other words, the piezoelectric members 320 may "shrink" so as to decrease the angle when the electric field is applied.

Figure 9:
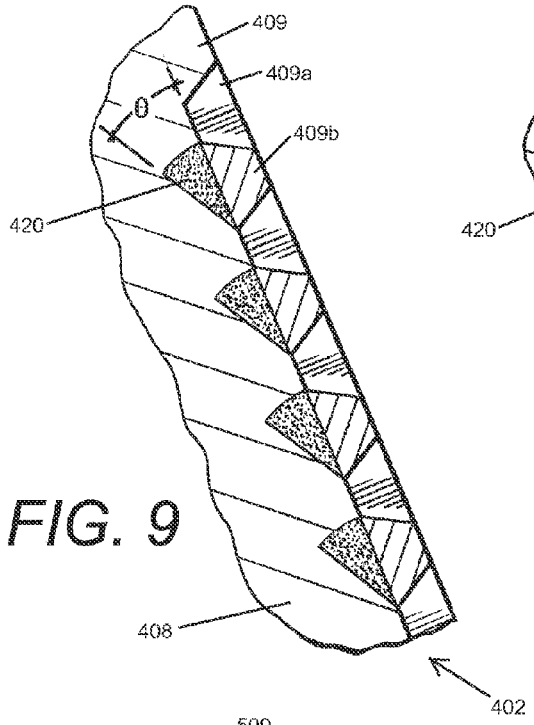
FIG. 9 is a partial enlarged cross-sectional view of an alternative embodiment of a golf club head in accordance with the present disclosure, and showing a piezoelectric member in a first position.
Figure 10:
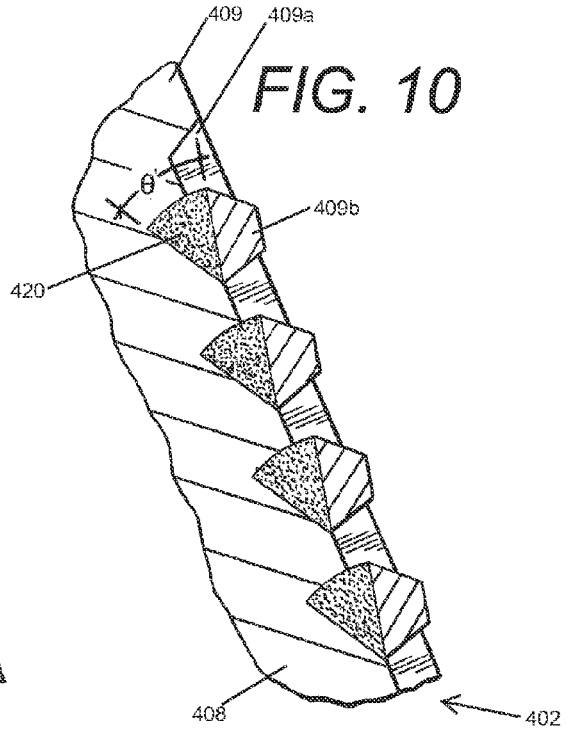
FIG. 10 is another partial enlarged cross-sectional view of the golf club head shown in FIG. 9, and showing the piezoelectric member in a second position.

According to aspects of the disclosure, piezoelectric material may be incorporated into a golf club head still in other ways to selectively control or adjust other attributes of the golf club head. For example, according to aspects of the disclosure piezoelectric material may be configured within the golf club head to control the angle of the grooves of the golf club head. For example, FIGS. 9-10 illustrate an alternative embodiment of a golf club head body 402 according to aspects of the disclosure. Specifically, FIG. 9 shows a cross-sectional view of an illustrative embodiment of the golf club head 402 according to aspects of the disclosure wherein piezoelectric members 420 are in a first position. FIG. 10 shows a cross-sectional view of the illustrative embodiment of the golf club head 402 according to aspects of the disclosure wherein piezoelectric members 420 are in a second position.

It is noted that several features of the embodiment shown in FIGS. 9 and 10 are similar to the embodiments described above and, therefore, for the sake of brevity will not be elaborated on in detail here. However, it is noted that according to aspects of the disclosure and as illustrated in the embodiment shown in FIGS. 9 and 10, the piezoelectric members 420 may be configured within the golf club head 402 to selectively control and adjust the angle of the grooves 409*a* of the golf club head 402. Hence, as will be discussed below, according to aspects of the disclosure, the piezoelectric members 402 may be used to selectively control and adjust the amount of spin the golf club head 402 imparts to the golf ball during a golf shot.

As seen in the illustrative embodiment shown in FIGS. 9 and 10, according to aspects of the disclosure, the piezoelectric members 420 may be configured to be positioned behind the individual slat 409*b* in the ball striking face 409 which at least in part defines the grooves 409*a* of the ball striking face 409 of the golf club head 409. For example, as seen in FIGS. 9 and 10, the piezoelectric members 420 may be configured to extend substantially or entirely behind each individual slat 409*b* in the ball striking face 409 of the golf club head 402. Further, as seen in FIGS. 9 and 10, according to aspects of the disclosure, piezoelectric members 420 may be configured such that the depth, or thickness, of the piezoelectric member 420 may vary with the height of the piezoelectric member 420. For example, as seen in FIGS. 9 and 10, the thickness of the piezoelectric members 420 is greater at the upper portion of each of the piezoelectric members 420 than the lower portion of each of the piezoelectric member 420. For example, the upper portion of the piezoelectric members 420 may each have a thickness in the range of 1.0-1.4 mm and the lower portion of each of the piezoelectric member 320 may have a thickness in the range of 0.5-0.7 mm. Further, as will be discussed below, the piezoelectric member 420 may include an angled configuration.

FIG. 9 illustrates the piezoelectric members 420 in the golf club head 402 in a first position (e.g., an original state) when no electric field has been applied to the piezoelectric members 420. As seen in FIG. 7, the piezoelectric members 420 have a first configuration which includes an angle Ø. In contrast, FIG. 10 illustrates the piezoelectric members 420 in the golf club head 402 in a second position (e.g., a deformed state) when an electric field has been applied to the piezoelectric member 420. As seen FIG. 10, the piezoelectric members 420 have a second configuration which includes an angle Ø' which is greater than Ø. Hence, the angle of the grooves 409*a* of the golf club head 402 is increased. Therefore, it is understood, that according to aspects of the disclosure, the angle of the grooves 409*a* in the golf club head 402 may be controlled (e.g., increased and decreased) by manipulating the piezoelectric members 420 positioned behind the slats of the ball striking face 409 of the golf club head 402 (e.g., by applying an electric field to the piezoelectric members 420). The angle of the grooves 409*a* may affect the amount of backspin imparted to a golf ball when the golf ball leaves the ball striking face 409. For example, grooves 409*a* with a more inclined angle may cause more backspin to be imparted to the golf ball during impact between the golf club head and the golf ball.

Therefore, according to aspects of the disclosure, and as seen by comparing FIG. 9 with FIG. 10, by manipulating the piezoelectric members 420 positioned behind each slat 409*b* of the ball striking face 409 of the golf club head 402, the angle of the grooves 409*a* of the golf club head 402 may be increased or decreased and, as a result, more or less backspin may be imparted to the golf ball during impact of the golf ball head with the golf ball during a golf swing. Further, it is noted that while FIGS. 9 and 10 represent two configurations of the piezoelectric members 420 other voltages could provide other angles as well. For example, FIG. 9 may represent an original state wherein no voltage is applied to the piezoelectric members 420 and the piezoelectric members 420 are configured such that Ø is 30°. Further, FIG. 10 may represent a state wherein 1.5V are applied to the piezoelectric members 420 and the piezoelectric members 420 are deformed such that Ø' is 32°. Additionally, while not shown, it is noted that according to aspects of the disclosure, a larger voltage (e.g., 3.0V) could be applied to the piezoelectric members 420 and the piezoelectric members 420 may be deformed even further to a point wherein the angle Ø is 34°. Of course, other voltages and angles are contemplated according to aspects of the disclosure and may be used as desired. For example, according to aspects of the disclosure, an angle may deform by 5° or less.

While the above described embodiment refers to a configuration wherein the piezoelectric members 420 define a first angle Ø when no electric field is applied and a second angle Ø' which is greater than first angle Ø when an electric field is applied, it is noted that other embodiments are within the scope of the disclosure. For example, according to other aspects of the disclosure, the piezoelectric members 420 define a first angle Ø when no electric field is applied and a second angle Ø' which is less than first angle Ø when an electric field is applied. In other words, the piezoelectric members 420 may "shrink" so as to decrease the angle when the electric field is applied.

Figure 11:
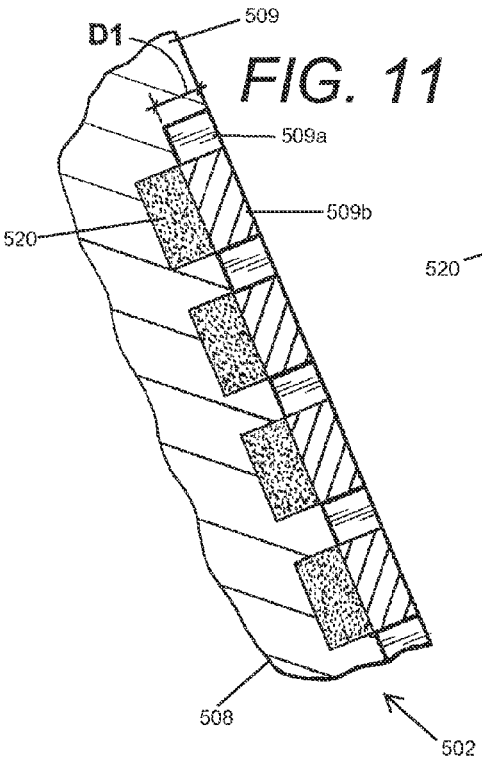
FIG. 11 is a partial enlarged cross-sectional view of an alternative embodiment of a golf club head in accordance with the present disclosure, and showing a piezoelectric member in a first position.
Figure 12:
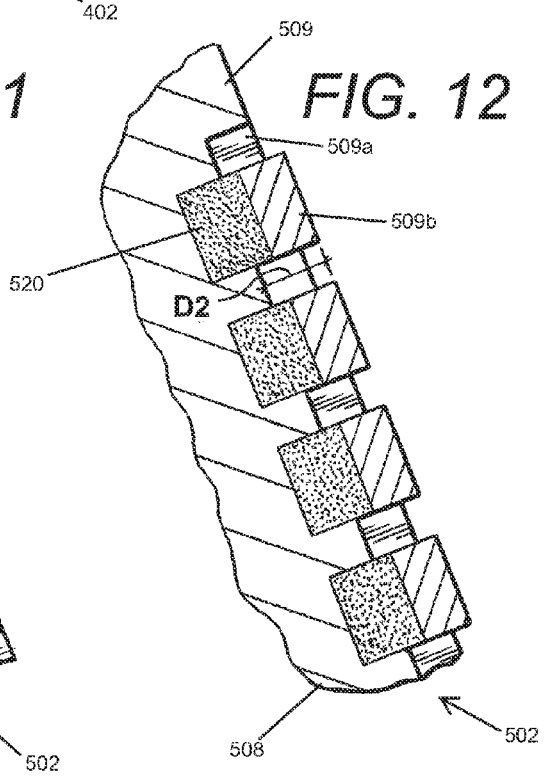
FIG. 12 is another partial enlarged cross-sectional view of the golf club head shown in FIG. 11, and showing the piezoelectric member in a second position.

According to aspects of the disclosure, piezoelectric material may be incorporated into a golf club head still in other ways to selectively control or adjust other attributes of the golf club head. For example, according to aspects of the disclosure piezoelectric material may be configured within the golf club head to control the depth or thickness of the slats in the ball striking face of the golf club head. For example, FIGS. 11-12 illustrate an alternative embodiment of a golf club head body according to aspects of the disclosure. Specifically, FIG. 11 shows a cross-sectional view of an illustrative embodiment of the golf club head 502 according to aspects of the disclosure wherein piezoelectric members 520 are in a first position. FIG. 12 shows a cross-sectional view of the illustrative embodiment of the golf club head 502 according to aspects of the disclosure wherein piezoelectric members 520 are in a second position.

It is noted that several features of the embodiment shown in FIGS. 11 and 12 are similar to the embodiments described above and, therefore, for the sake of brevity will not be elaborated on in detail here. However, it is noted that according to aspects of the disclosure and as illustrated in the embodiment shown in FIGS. 11 and 12, the piezoelectric members 520 may be configured within the golf club head 502 to selectively control and adjust the depth or thickness of the slats 509*b* of the ball striking face 509 that, define the grooves 509*a* of the golf club head 502. Hence, as will be discussed below, according to aspects of the disclosure, the piezoelectric members 520 may be used to selectively control and adjust the amount of spin the golf club head 502 imparts to the golf ball during a golf shot.

As seen in the illustrative embodiment shown in FIGS. 11 and 12, according to aspects of the disclosure, the piezoelectric members 520 may be positioned behind each individual slat 509*b* in the ball striking face 509 of the golf club head 509. For example, as seen in FIGS. 11 and 12, the piezoelectric members 520 may be configured to extend substantially or entirely behind each individual slat 509*b* in the ball striking face 509 of the golf club head 502. Further, as seen in FIGS. 11 and 12, according to aspects of the disclosure, piezoelectric members 520 may be configured such that the height (e.g., relative to the sole to crown direction) of the piezoelectric members 520 may be the same as the height of the corresponding slat 509*b* of the ball striking face 509.

FIG. 11 illustrates the piezoelectric members 520 in the golf club head 502 in a first position (e.g., an original state) when no electric field has been applied to the piezoelectric members 520. As seen FIG. 11, the slats 509*b* of the ball striking face 509 define, at least in part, grooves 509*a* which include a depth of D1. In contrast, Figure 12 illustrates the piezoelectric members 520 in the golf club head 502 in a second position (e.g., a deformed state) when an electric field has been applied to the piezoelectric members 520. As seen FIG. 12, the size of the piezoelectric members 520 has been increased and thereby, the slats 509*b* of the ball striking face 509 extend beyond the original plane of the ball striking face seen in FIG. 11. Therefore, the slats 509*b* of the ball striking face 509 now define grooves 509*a* of a second size which includes a depth of D2 which is greater than D1. Hence, the volume of the grooves 509*a* of the golf club head 502 is increased. Therefore, it is understood, that according to aspects of the disclosure, the volume of the grooves 509*a* of the golf club head 502 may be controlled (e.g., increased and decreased) by manipulating the piezoelectric members 520 positioned behind the slats 509*b* of the ball striking face 509 of the golf club head 502 (e.g., by applying an electric field to the piezoelectric members 520).

As discussed above with regard to the first embodiment, the grooves 509*a* can affect the friction created between the ball striking face 509 and the golf ball. For example, the dimensions of the grooves may affect the amount of friction applied to the golf ball and thereby the amount of backspin the golf ball has when it leaves the ball striking face 509 during the golf shot. For example, larger and deeper grooves may have more grip and also prevent debris (e.g., dirt, sand, grass, etc.) from being caught between the golf ball and the ball striking face, thereby letting the groove contact the golf ball.

Therefore, according to aspects of the disclosure, and as seen by comparing FIG. 11 with FIG. 12, by manipulating the piezoelectric members 520 positioned behind the slats 509*b* of the ball striking face 509 of the golf club head 502, the volume of the grooves 509*a* of the golf club head may be increased or decreased and, as a result, more or less backspin may be created during impact of the golf club head 502 with the golf ball during a golf swing. Further, it is noted that while FIGS. 11 and 12 represent two sizes of the piezoelectric members 520, other voltages may be applied to provide other sizes as well. For example, FIG. 11 may represent an original state wherein no voltage is applied to the piezoelectric members 520 and the piezoelectric members 520 are configured such that D1 is 0.5 mm. Further, FIG. 12 may represent a state wherein 1.5V are applied to the piezoelectric members 520 and the piezoelectric members 520 are deformed such that D2 is 0.6 mm. Additionally, while not shown, it is noted that according to aspects of the disclosure, a larger voltage (e.g., 3.0V) could be applied to the piezoelectric members 520 and the piezoelectric members 520 may be deformed even further to a point wherein the depth (e.g., D3) is 0.7 mm. Of course, other voltages and dimensions are contemplated according to aspects of the disclosure and may be used as desired.

While the above described embodiment refers to a configuration wherein the piezoelectric members 520 have a first size which defines a groove of a depth of D1 when no electric field is applied and a second size which defines a groove of a depth of D2 which is greater than D1 when an electric field is applied, it is noted that other embodiments are within the scope of the disclosure. For example, according to other aspects of the disclosure, the piezoelectric members 520 have a first size which defines a groove a depth of D1 when no electric field is applied and a second size which defines a groove a depth of D2 which is smaller than D1 when an electric field is applied. In other words, the piezoelectric members 120 may "shrink" when the electric field is applied. Hence, the slats 509*b* of the ball striking face 509 are withdrawn within the original plane of the ball striking face seen in FIG. 11.

Figure 14:
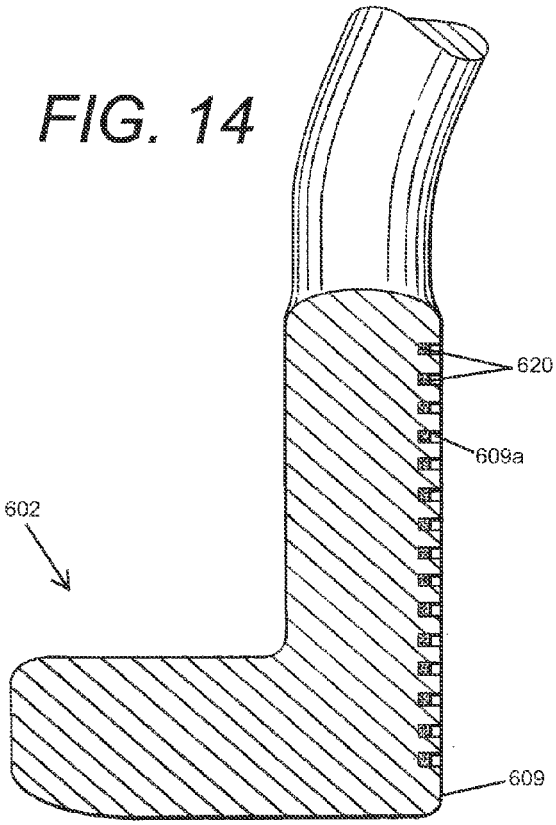
FIG. 14 is a cross-sectional view of an alternative embodiment of a golf club head in according with the present disclosure.

As mentioned above, while the disclosure has been described primarily in terms of use in an iron-type golf club head (including iron type-hybrid golf club heads), those skilled in the art will appreciate that aspects and features of this disclosure are not limited to use with iron-type golf club heads. For example, if desired, putter-type and/or wood-type body members may be substituted for the iron-type club head body members illustrated in FIGS. 1 and 3-12, and the same or similar features and/or structures could be included in a putter or wood structure without departing from this disclosure. For example, FIG. 14 illustrates an embodiment according to aspects of the disclosure in which a putter-type golf club head 602 is configured with a plurality of piezoelectric members 620 engaged with grooves of in the ball striking face 609 of the putter-type golf club head 602. In this way the volume of the grooves 609*a* can be adjusted in a manner similar to that described above with regard to the embodiment shown in FIGS. 1 and 3, 4, 5A and 5B. Hence, it is understood that any of the various features described above may be incorporated into various types of golf club heads and golf club structures including iron-type, wood-type, hybrid-type, putter-type, etc., golf club heads and golf club structures.

III. Conclusion

The present disclosure is described above and in the accompanying drawings with reference to a variety of example structures, features, elements, and combinations of structures, features, and elements. The purpose served by the disclosure, however, is to provide examples of the various features and concepts related to the disclosure, not to limit the scope of the disclosure. One skilled in the relevant art will recognize that numerous variations and modifications may be made to the embodiments described above without departing from the scope of the present disclosure, as defined by the appended claims. For example, the various features and concepts described above in conjunction with FIGS. 1 and 3-14 may be used individually and/or in any combination or subcombination without departing from this disclosure.

What is claimed is:

1. A golf club head comprising:

a golf club head body;

a ball striking face; and a piezoelectric member in the golf club head, wherein the piezoelectric member is configured to be selectively adjusted by an input provided through a controller operably connected to the piezoelectric member, wherein the piezoelectric member is capable of having a first configuration to provide the golf club head body with a first attribute and capable of having a second configuration to provide the body with a second attribute in response to the input provided by the controller, the second attribute being different from the first attribute, wherein the golf club head includes a plurality of grooves in the ball striking face, wherein the first and second attributes are volumes of one or more of the plurality of grooves.

2. The golf club head according to claim 1, wherein the piezoelectric member includes a plurality of piezoelectric members each of which is positioned in a respective groove of the plurality of grooves in the ball striking face.

3. The golf club head according to claim 2, wherein the first configuration of the piezoelectric member includes the plurality of piezoelectric members positioned in the plurality of grooves of the ball striking face each having a first size, and the second configuration of the piezoelectric member includes the plurality of piezoelectric members positioned in the plurality of grooves of the ball striking face each having a second size.

4. The golf club head according to claim 1, wherein the golf club head includes a plurality of slats in the ball striking face which define the grooves in the ball striking face.

5. The golf club head according to claim 4, wherein the piezoelectric member includes a plurality of piezoelectric members each of which is positioned behind a slat of the plurality of slats in the ball striking face.

6. The golf club head according to claim 5, wherein the first configuration of the piezoelectric member includes the plurality of piezoelectric members positioned behind the plurality of slats of the ball striking face each having a first size, and the second configuration of the piezoelectric member includes the plurality of piezoelectric members positioned behind the plurality of slats of the ball striking face each having a second size.

7. The golf club head according to claim 5, wherein the second configuration of the piezoelectric member includes the slats of the ball striking face extending beyond a plane of the ball striking face of the first configuration.

8. The golf club head according to claim 1, wherein the golf club head is an iron-type golf club head.

9. The golf club head according to claim 1, wherein the golf club head is a wood-type golf club head.

10. The golf club head according to claim 1, wherein the golf club head is a putter head.

11. The golf club head according to claim 1, wherein the controller is configured to apply a voltage to the piezoelectric member to alter the configuration of the piezoelectric member.

12. The golf club head according to claim 11, wherein the controller is configured to allow the voltage applied to the piezoelectric member to be selectively adjusted.

13. A golf club head comprising:

a golf club head body;

a ball striking face;

a cavity located behind the ball striking face; and a piezoelectric member in the golf club head, wherein the piezoelectric member is configured to be selectively adjusted by an input provided through a controller operably connected to the piezoelectric member, wherein the piezoelectric member is capable of having a first configuration to provide the golf club head body with a first attribute and capable of having a second configuration to provide the body with a second attribute in response to the input provided by the controller, the second attribute being different from the first attribute, wherein the piezoelectric member includes a plate configured to extend substantially behind the ball striking face of the golf club head, wherein the first configuration of the piezoelectric member includes the piezoelectric member having a first size, and the second configuration of the piezoelectric member includes the piezoelectric member having a second size, wherein the piezoelectric member intrudes into and fills the cavity either in the first configuration or the second configuration.

14. The golf club head according to claim 13, wherein the first configuration of the piezoelectric member provides a first internal stress behind the ball striking face of the golf club head and the second configuration of the piezoelectric member provides a second internal stress behind the ball striking face of the golf club head, which is different from the first internal stress.

15. A golf club comprising:

the golf club head of claim 14; and a shaft configured to be engaged with the golf club head.

16. The golf club head according to claim 13, wherein the first configuration of the piezoelectric member includes the piezoelectric member having a first thickness at a first end thereof and a second thickness at a second end thereof such that the piezoelectric member exhibits a first angle from the second end towards the first end and the second configuration of the piezoelectric member includes the piezoelectric member exhibiting a second angle from the second end towards the first end, which is different from the first angle.

17. The golf club head according to claim 16, wherein the first and second attributes are loft angles of the golf club head.

18. A golf club head comprising:

a golf club head body;

a ball striking face; and a piezoelectric member in the golf club head, wherein the piezoelectric member is configured to be selectively adjusted by an input provided through a controller operably connected to the piezoelectric member, wherein the piezoelectric member is capable of having a first configuration to provide the golf club head body with a first attribute and capable of having a second configuration to provide the body with a second attribute in response to the input provided by the controller, the second attribute being different from the first attribute, wherein the golf club head includes a plurality of grooves in the ball striking face and a plurality of slats in the ball striking face which define the grooves in the ball striking face wherein the first and second attributes are angles of one or more of the plurality of grooves.

19. The golf club head according to claim 18, wherein the piezoelectric member includes a plurality of piezoelectric members each of which is positioned behind a slat of the plurality of slats of the ball striking face.

20. The golf club head according to claim 19, wherein the first configuration of the piezoelectric member includes the plurality of piezoelectric members positioned behind the plurality of slats of the ball striking face each having a first size, and the second configuration of the piezoelectric member includes the plurality of piezoelectric members positioned behind the plurality of slats of the ball striking face each having a second size.

21. The golf club head according to claim 20, wherein the first configuration of the piezoelectric member includes each of the piezoelectric members having a first thickness at a first end thereof and a second thickness at a second end thereof such that each of the piezoelectric members exhibits a first angle from the second end towards the first end and the second configuration of the piezoelectric member includes each of the piezoelectric members exhibiting a second angle from the second end towards the first end, which is different from the first angle.

22. A golf club comprising:

a golf club head which includes:

a golf club head body;

a ball striking face; and a piezoelectric member in the golf club head body;

a shaft configured to be engaged with the golf club head; and a controller operably connected to the piezoelectric member, wherein the controller is configured to allow the user to selectively adjust a configuration of the piezoelectric member by providing an input through the controller, wherein the piezoelectric member is capable of having a first configuration to provide the golf club head body with a first attribute and capable of having a second configuration to provide the body with a second attribute in response to the input provided by the controller, the second attribute being different from the first attribute, wherein the golf club head includes a plurality of grooves in the ball striking face, wherein the first and second attributes are volumes of one or more of the plurality of grooves, wherein the piezoelectric member includes a plurality of piezoelectric members each of which is engaged in a groove of the plurality of grooves in the ball striking face, wherein the first configuration of the piezoelectric member includes the plurality of piezoelectric members positioned in the plurality of grooves of the ball striking face each having a first size, and the second configuration of the piezoelectric member includes the plurality of piezoelectric members positioned in the plurality of grooves of the ball striking face each having a second size.

23. A golf club comprising:

a golf club head which includes:

a golf club head body;

a ball striking face; and a piezoelectric member in the golf club head body;

a shaft configured to be engaged with the golf club head; and a controller operably connected to the piezoelectric member, wherein the controller is configured to allow the user to selectively adjust a configuration of the piezoelectric member by providing an input through the controller, wherein the piezoelectric member is capable of having a first configuration to provide the golf club head body with a first attribute and capable of having a second configuration to provide the body with a second attribute in response to the input provided by the controller, the second attribute being different from the first attribute, wherein the first and second attributes are loft angles of the golf club head, wherein the piezoelectric member includes a plate configured to extend substantially behind the ball striking face of the golf club head, wherein the first configuration of the piezoelectric member includes the piezoelectric member having a first size, and the second configuration of the piezoelectric member includes the piezoelectric member having a second size, wherein the first configuration of the piezoelectric member includes the piezoelectric member have a first thickness at a first end thereof and a second thickness at a second end thereof such that the piezoelectric member exhibits a first angle from the second end towards the first end and the second configuration of the piezoelectric member includes the piezoelectric member exhibiting a second angle from the second end towards the first end, which is different from the first angle, thereby changing the loft angle of the golf club head.

24. A golf club comprising:

a golf club head which includes:

a golf club head body;

a ball striking face; and a piezoelectric member in the golf club head body;

a shaft configured to be engaged with the golf club head; and a controller operably connected to the piezoelectric member, wherein the controller is configured to allow the user to selectively adjust a configuration of the piezoelectric member by providing an input through the controller, wherein the piezoelectric member is capable of having a first configuration to provide the golf club head body with a first attribute and capable of having a second configuration to provide the body with a second attribute in response to the input provided by the controller, the second attribute being different from the first attribute, wherein the golf club head includes a plurality of grooves in the ball striking face and a plurality of slats in the ball striking face which define the grooves in the ball striking face, wherein the first and second attributes are angles of one or more of the plurality of grooves, wherein the piezoelectric member includes a plurality of piezoelectric members each of which is positioned behind a slat of the plurality of slats in the ball striking face, wherein the first configuration of the piezoelectric member includes the plurality of piezoelectric members positioned behind the plurality of slats of the ball striking face each having a first size, and the second configuration of the piezoelectric member includes the plurality of piezoelectric members positioned behind the plurality of slats of the ball striking face each having a second size, wherein the first configuration of the piezoelectric member includes each of the piezoelectric members having a first thickness at a first end thereof and a second thickness at a second end thereof such that each of the piezoelectric members exhibit a first angle from the second end towards the first end and the second configuration of the piezoelectric member includes each of the piezoelectric members exhibiting a second angle from the second end towards the first end, which is different from the first angle.

25. A golf club comprising:

a golf club head which includes:

a golf club head body;

a ball striking face; and a piezoelectric member in the golf club head body;

a shaft configured to be engaged with the golf club head; and a controller operably connected to the piezoelectric member, wherein the controller is configured to allow the user to selectively adjust a configuration of the piezoelectric member by providing an input through the controller, wherein the piezoelectric member is capable of having a first configuration to provide the golf club head body with a first attribute and capable of having a second configuration to provide the body with a second attribute in response to the input provided by the controller, the second attribute being different from the first attribute, wherein the golf club head includes a plurality of grooves in the ball striking face and a plurality of slats in the ball striking face which define the grooves in the ball striking face, wherein the first and second attributes are volumes of one or more of the plurality of grooves, wherein the piezoelectric member includes a plurality of piezoelectric members each of which is positioned behind a slat of the plurality of slats in the ball striking face, wherein the first configuration of the piezoelectric member includes the plurality of piezoelectric members positioned behind the plurality of slats of the ball striking face each having a first size, and the second configuration of the piezoelectric member includes the plurality of piezoelectric members positioned behind the plurality of slats of the ball striking face each having a second size, wherein the second configuration of the piezoelectric member includes the slats of the ball striking face extending beyond a plane of the ball striking face of the first configuration.

26. The golf club according to claim 22, wherein the golf club is an iron-type golf club.

27. The golf club according to claim 22, wherein the golf club is a wood-type golf club.

28. The golf club according to claim 22, wherein the golf club is a putter.

29. The golf club according to claim 22, wherein the controller is configured to apply a voltage to the piezoelectric member to alter the configuration of the piezoelectric member.

30. The golf club according to claim 29, wherein the controller is configured to allow the voltage applied to the piezoelectric member to be selectively adjusted.

31. The golf club according to claim 30, wherein the controller is engaged with the shaft of the golf club.

32. The golf club according to claim 31, wherein the controller is includes a knob engaged with the shaft of the golf club, wherein the knob is configured to be rotated to adjust the voltage applied to the piezoelectric member.

33. A golf club head comprising:

a golf club head body;

a ball striking face which includes a plurality of grooves in the ball striking face; and a plurality of piezoelectric members each of which is positioned in a groove of the plurality of grooves in the ball striking face, wherein the piezoelectric members are configured to selectively adjust the volume in the grooves in the ball striking face, by an input provided through a controller operably connected to the piezoelectric members, wherein the input is configured to apply a voltage to the piezoelectric members which alters the configuration of the piezoelectric members between at least a first size, when no voltage is applied, and a second size when a voltage is applied.

34. A golf club head comprising:

a golf club head body;

a ball striking face;

a cavity located behind the ball striking face; and a piezoelectric member in the golf club head body, wherein the piezoelectric member includes a plate configured to extend substantially behind the ball striking face of the golf club head, wherein the piezoelectric member is configured to selectively adjust an internal stress behind the ball striking face, by an input provided through a controller operably connected to the piezoelectric members, wherein the input is configured to apply a voltage to the piezoelectric member which alters the configuration of the piezoelectric member between at least a first size, when no voltage is applied, and a second size when a voltage is applied, wherein the piezoelectric member intrudes into and fills the cavity either when the voltage is applied or when no voltage is applied.

35. A golf club head comprising:

a golf club head body;

a ball striking face; and a piezoelectric member in the golf club head body, wherein the piezoelectric member includes a plate configured to extend substantially behind the ball striking face of the golf club head and has a first thickness at a first end thereof and a second thickness at a second end thereof such that the piezoelectric member exhibits an angle from the second end towards the first end, wherein the piezoelectric member is configured to selectively adjust a loft angle of the golf club head, by an input provided through a controller operably connected to the piezoelectric members, wherein the input is configured to apply a voltage to the piezoelectric member which alters the configuration of the piezoelectric member between at least a first size and a first angle, when no voltage is applied, and a second size, which is larger than the first size, and a second angle when a voltage is applied.

36. A golf club head comprising:

a golf club head body;

a ball striking face which includes a plurality of grooves in the ball striking face and a plurality of slats in the ball striking face which define the grooves in the ball striking face; and a plurality of piezoelectric members each of which is positioned behind a slat of the plurality of slats in the ball striking face, wherein the piezoelectric members are configured to selectively adjust the angle of the grooves in the ball striking face, by an input provided through a controller operably connected to the piezoelectric members, wherein the input is configured to apply a voltage to the piezoelectric members which alters the configuration of the piezoelectric members between at least a first size and a first angle, when no voltage is applied, and a second size, which is larger than the first size, and a second angle when a voltage is applied.

37. A golf club head comprising:

a golf club head body;

a ball striking face which includes a plurality of grooves in the ball striking face and a plurality of slats in the ball striking face which define the grooves in the ball striking face; and a plurality of piezoelectric members each of which is positioned behind a slat of the plurality of slats in the ball striking face, wherein the piezoelectric members are configured to selectively adjust the volume of the grooves in the ball striking face, by an input provided through a controller operably connected to the piezoelectric members, wherein the input is configured to apply a voltage to the piezoelectric members which alters the configuration of the piezoelectric members between at least a first size, when no voltage is applied, and a second size when a voltage is applied.

* * * * *